US006168534B1

(12) United States Patent
Schultz

(10) Patent No.: US 6,168,534 B1
(45) Date of Patent: Jan. 2, 2001

(54) GOLF CLUB WITH INTERCHANGEABLE HEAD

(76) Inventor: Robert G. Schultz, R.R. 3, Golfview, Centerville, IA (US) 52544

( * ) Notice: Under 35 U.S.C. 154(b), the term of this patent shall be extended for 0 days.

(21) Appl. No.: 09/247,462

(22) Filed: Feb. 9, 1999

(51) Int. Cl.[7] ..... A63B 53/02
(52) U.S. Cl. ..... 473/299; 473/312; 473/313
(58) Field of Search ..... 473/305, 306, 473/307, 313, 296, 298, 299, 288, 239, 244–278, 251, 312

(56) References Cited

U.S. PATENT DOCUMENTS

| | | | |
|---|---|---|---|
| D. 139,463 | | 11/1944 | Jakosky . |
| 1,253,700 | | 1/1918 | McLaughlin . |
| 1,601,770 | * | 10/1926 | Reach . |
| 1,932,902 | * | 10/1933 | McDowell . |
| 2,275,330 | * | 3/1942 | Tveten . |
| 2,691,525 | * | 10/1954 | Callaghan . |
| 3,424,459 | | 1/1969 | Evancho . |
| 3,524,646 | | 8/1970 | Wheeler . |
| 3,829,092 | | 8/1974 | Arkin . |
| 3,848,737 | | 11/1974 | Kenon . |
| 3,891,212 | | 6/1975 | Hill . |
| 3,893,670 | | 7/1975 | Franchi . |
| 4,253,666 | | 3/1981 | Murphy . |
| 4,943,059 | * | 7/1990 | Morell . |

* cited by examiner

*Primary Examiner*—Jeanette Chapman
*Assistant Examiner*—Stephen L. Blau
(74) *Attorney, Agent, or Firm*—Zarley, McKee, Thomte, Voorhees & Sease

(57) ABSTRACT

A conventional golf club head is releasably connected to a golf club shaft through operation of a wedge on the lower end of a rod in the shaft moveable in and out of the lower end of the shaft to releasably cause the shaft side wall to create a friction fit in the hollow club head shank. A nut on the rod at the upper end of the shaft covered by a cap allows for rotation of the rod to advance or retract the wedge in the lower end of the shaft.

9 Claims, 2 Drawing Sheets

GOLF CLUB WITH INTERCHANGEABLE HEAD

BACKGROUND OF THE INVENTION

Golf rules and the size of golf bags limit the number of clubs a golfer can carry. The speed of putts on putting greens vary depending on a number of different conditions. Some greens are fast and others are slow. Many golfers feel there is an appropriate putter for each of these different greens. Putters may vary with the softness or hardness of the putting face.

A number of different approaches to providing interchangeable golf heads are suggested in prior art patents such as Wheeler 3,524,646 and Evancho 3,424,459. Neither of these putters, however, allow use of the conventional putter head but instead, require special heads and shafts. What is needed is a golf club shaft that will interchangeably fit into any putter head shank.

SUMMARY OF THE INVENTION

Any desired club head, and in particular putter club heads, can be interchangeably connected to the conventional shaft which has been slightly modified to releasably engage the shank.

A rod extends the length of the hollow shaft and threadably engages a conical wedge on its lower end which is adapted to move in and out of the lower end of the hollow shaft which has been longitudinally slotted around its periphery to allow the side wall of the shaft to be pressed outwardly by the wedge against the interior wall of the hollow shank. A control assembly is provided on the upper end of the rod to allow for rotation of the rod to cause the wedge to move in and out of the lower end of the hollow shaft. A cap is placed over the upper end of the shaft obscuring the nut locked onto the shaft for rotating the shaft.

It is thus seen that a conventional golf club shaft could be modified by serrating the lower end to provide slots and adding a rod extending the length of the shaft and providing a wedge on the lower end. The maximum diameter of the wedge is substantially equal to the outer diameter of the shaft which in turn is substantially equal to the interior diameter of the club head shank. Thus, the thickness of the shaft wall is sufficient to allow for a friction fit connection between the shaft and the club head shank by pulling the wedge tight into the lower end of the shaft by operation of the nut on the upper end of the shaft which bears against the upper end of the shaft.

DESCRIPTION OF THE PREFERRED EMBODIMENT

Figures 1, 2, 5:
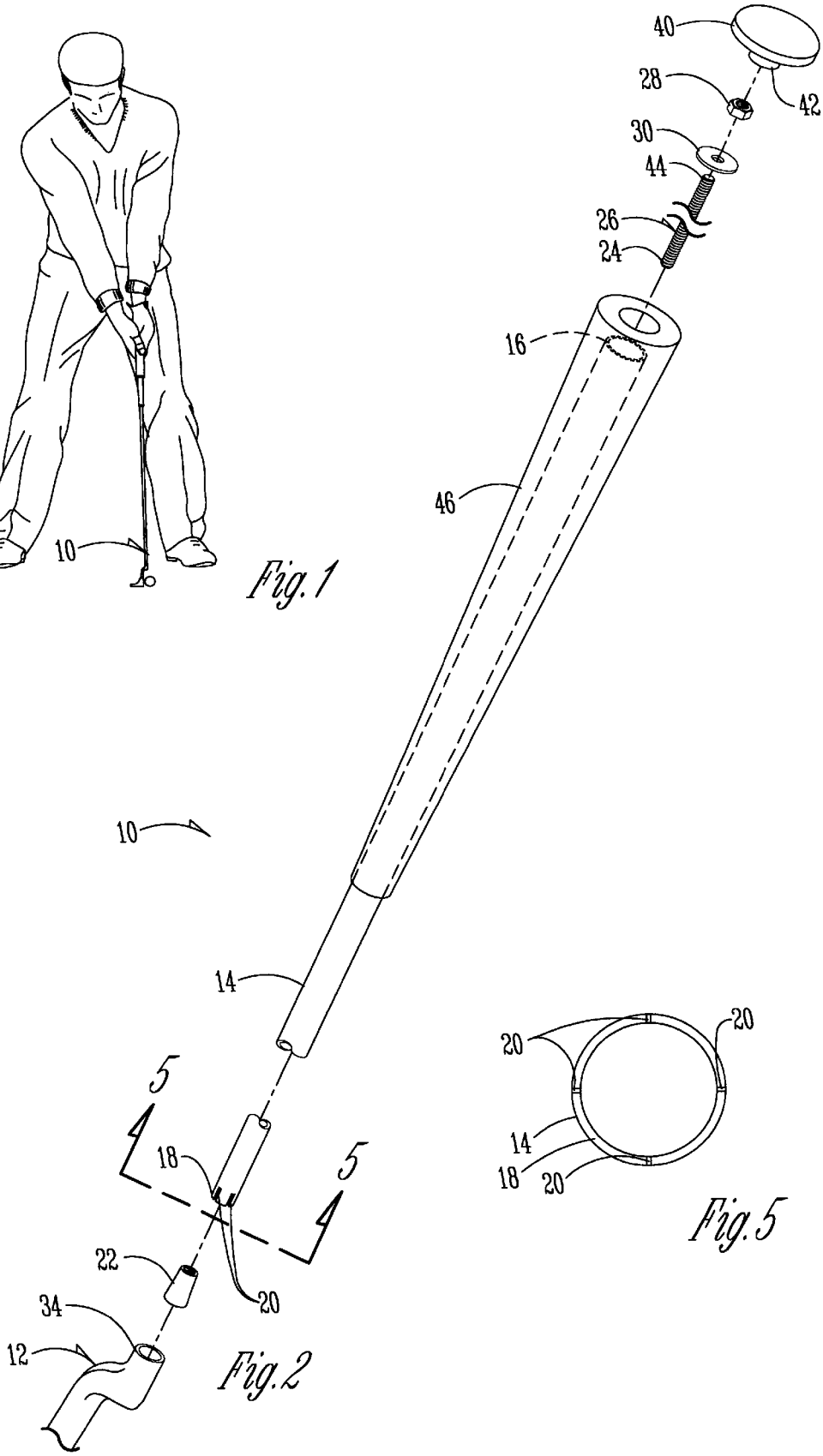
FIG. 1 is a perspective view of the golf club of this invention being used by a golfer.
FIG. 2 is an exploded fragmentary perspective view of the golf club.
FIG. 5 is a cross-sectional view taken along line 5—5 in FIG. 2.
Figure 3:
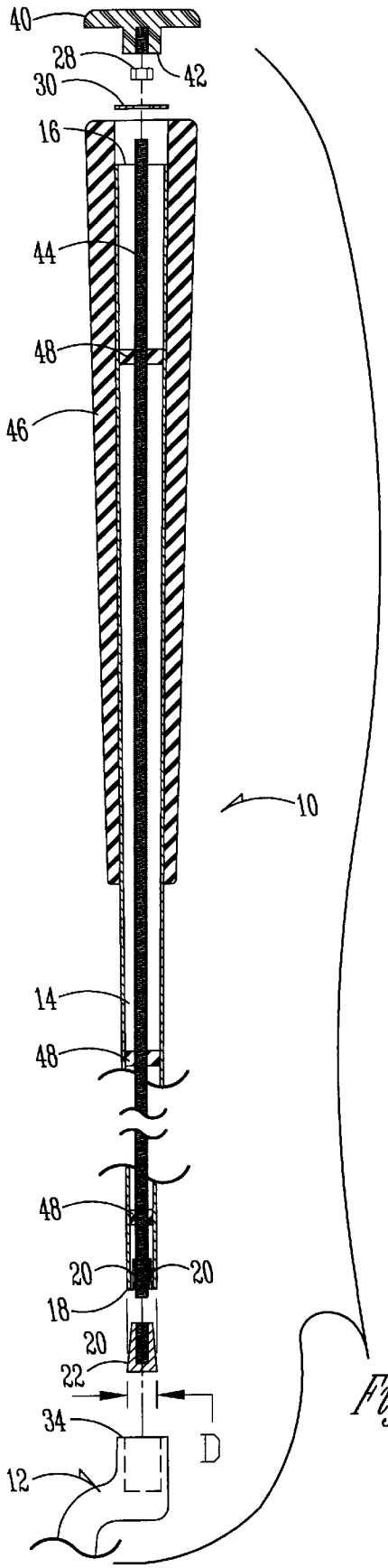
FIG. 3 is an exploded longitudinal cross-sectional view of the golf club.

The golf club of this invention is referred to generally in FIG. 1 by the reference numeral 10 and includes a putter club head 12 releasably connected to a shaft 14.

The shaft 14 includes an upper end 16 and lower end 18 which is serrated to provide for longitudinally spaced apart slots 20. A tapered conical wedge 22 threadably engages the lower end of a rod 26 which is rotateable by a nut 28 which presses against a washer 30 engaging the upper end 16 of the shaft 14 as seen in FIG. 4.

The putter club head 12 includes a hollow shank 34 having an interior diameter approximately equal to the maximum diameter of the wedge 22 and the lower exterior diameter of the lower end 18 of the shaft 14 such that when the rod 26 is rotated the wedge 22 will move in and out of the lower end 18 of the shaft 14 causing the side wall portions of the lower end 18 to move laterally inwardly and outwardly relative to the interior side wall of the hollow shank 34.

Figure 4:
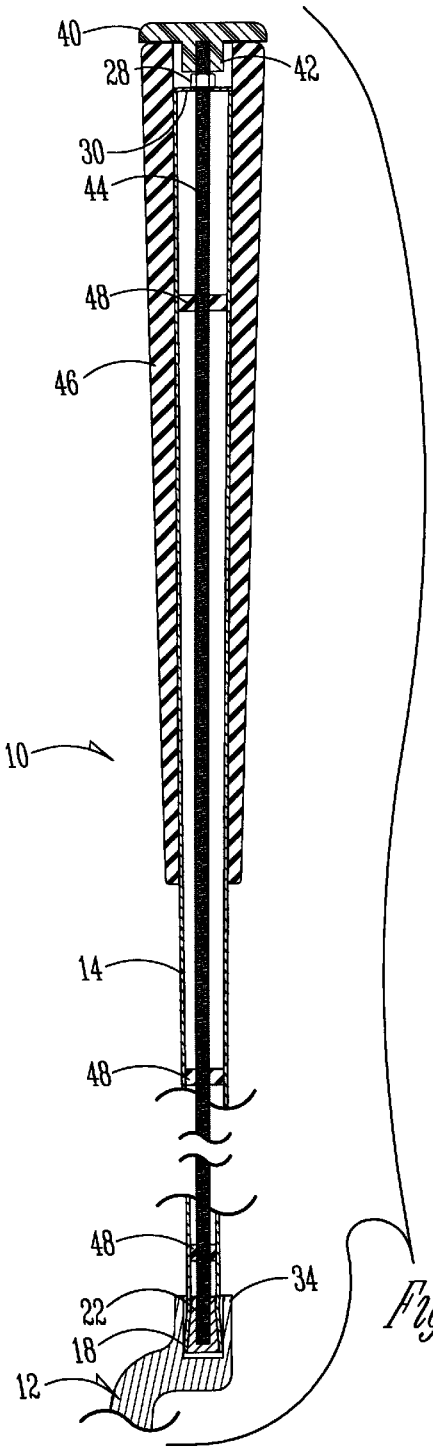
FIG. 4 is a longitudinal cross-sectional view of an assembled golf club.

A cap 40 includes a threaded shoulder 42 for threadably engaging the upper end 44 of the threaded rod 26 outwardly of the nut 28 as seen in FIG. 4 thereby allowing removal of the cap to access the nut 28 for operation of the wedge 22 for connecting and disconnecting a club head 12 to the lower end 18 of the shaft 14. A conventional grip 46 is provided on the shaft 14 and extends slightly beyond the upper end 16 of the shaft 14 to receive the washer 30 and nut 28.

A plurality of spacers 48 are provided on the rod 26 to insulate the rod from the interior side wall of the shaft 14.

It is thus seen that any desired conventional golf club head, and in particular putter heads, can be quickly interchangeably connected to a slightly modified conventional golf club shaft 14. The modification only requires slotting the lower end 18 of the shaft, inserting a rod 26 in the shaft 14 and providing a wedge 22 on the lower end of the rod for movement into and out of shaft lower end 18.

What is claimed is:

1. A golf club comprising, an elongated hollow shaft having upper and lower ends, a club head having a blade and an upstanding hollow shank to receive said hollow shaft lower end, a rod having upper and lower ends in said elongated hollow shaft and engaging a wedge at its lower end, said wedge adapted to be positioned in said hollow shank and move in and out of said lower end of said elongated hollow shaft upon said rod being moved longitudinally in said shaft whereby said club head is locked onto said shaft when said wedge is in said shaft and released when said wedge is loosened in said shaft, and a control assembly being provided at the upper end of said hollow shaft in engagement with said rod for rotating said rod.

2. The golf club of claim 1 wherein said control assembly includes a nut integrally connected to said upper end of said rod operably bearing against the upper end of said shaft for maintaining said rod longitudinally stationary as said nut is rotated and said wedge is moved into and out of said lower end of said shaft.

3. The golf club of claim 2 and a cap is positioned on the upper end of said shaft over said nut.

4. The golf club of claim 1 wherein said lower end of said shaft has a side wall having inner and outer surfaces and a plurality of longitudinal slots in said side wall for allowing said side wall to move laterally inwardly and outwardly in response to movement outwardly and inwardly of said wedge in said lower end of said hollow shaft.

5. The golf club of claim 4 wherein said wedge is tapered upwardly from a large cross-sectional area to a smaller cross-sectional area.

6. The golf club of claim 5 wherein said wedge is conical in shape.

7. The golf club of claim 6 wherein said wedge has a maximum diameter substantially corresponding to the interior diameter of said hollow shank and said lower end of said hollow shaft having an outer diameter substantially corresponding to the interior diameter of said hollow shank.

8. The golf club of claim 1 wherein said wedge is tapered upwardly from a large cross-sectional area to a smaller cross-sectional area.

9. A golf club comprising, an elongated hollow shaft having upper and lower ends, a club head having a blade and an upstanding hollow shank to receive said hollow shaft lower end, a rod having upper and lower ends in said elongated hollow shaft and engaging a wedge at its lower end, said wedge adapted to be positioned in said hollow shank and move in and out of said lower end of said elongated hollow shaft upon said rod being moved longitudinally in said shaft whereby said club head is locked onto said shaft when said wedge is in said shaft and released when said wedge is loosened in said shaft, and cushion spacer elements being provided on said rod for engaging the interior side wall of said shaft.

* * * * *